US010425752B2

(12) United States Patent
Kral et al.

(10) Patent No.: US 10,425,752 B2
(45) Date of Patent: Sep. 24, 2019

(54) HEARING AID WITH PLUG CONNECTION FOR EARPIECE

(71) Applicant: SIVANTOS PTE. LTD., Singapore (SG)

(72) Inventors: Holger Kral, Fuerth (DE); Bernd Meister, Erlangen (DE); Kristina Haeder, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/822,890

(22) Filed: Nov. 27, 2017

(65) Prior Publication Data

US 2018/0084354 A1 Mar. 22, 2018

Related U.S. Application Data

(63) Continuation of application No. PCT/EP2016/053594, filed on Feb. 19, 2016.

(30) Foreign Application Priority Data

May 27, 2015 (DE) ..... 10 2015 209 741

(51) Int. Cl.
*H04R 25/00* (2006.01)
*H04R 1/10* (2006.01)
*H04R 25/02* (2006.01)

(52) U.S. Cl.
CPC ..... *H04R 25/65* (2013.01); *H04R 1/1016* (2013.01); *H04R 1/1066* (2013.01); *H04R 25/02* (2013.01);

(Continued)

(58) Field of Classification Search
CPC .... H04R 25/65; H04R 25/608; H04R 25/652; H04R 25/656; H04R 25/258; H04R 1/1066; H04R 2201/10
See application file for complete search history.

(56) References Cited

U.S. PATENT DOCUMENTS 3,732,382 A * 5/1973 DeWitt ..... H04R 25/656 181/130
3,813,499 A * 5/1974 Vignini ..... H04R 25/60 381/324

(Continued)

FOREIGN PATENT DOCUMENTS

CN 201222797 Y 4/2009
DE 9104515 U1 9/1991

(Continued)

*Primary Examiner* — Joshua Kaufman
(74) *Attorney, Agent, or Firm* — Laurence A. Greenberg; Werner H. Stemer; Ralph E. Locher

(57) ABSTRACT

A hearing aid contains an ear insert which has an earpiece and a connection part which is connected to a receiver. The earpiece and the connection part each has a plug connector and are connected together by the plug connectors. One plug connector is a connection piece which extends in an axial direction along a longitudinal axis and has a thickened portion in the radial direction, and the other plug connector engages behind the thickened portion in order to axially fix the earpiece to the connection part. The thickened portion has an undercut and forms a retaining surface which runs into the thickened portion in a wedged manner. In this manner, the earpiece is attached to the connection part in a particularly secured manner.

14 Claims, 1 Drawing Sheet

(52) U.S. Cl.
CPC ..... *H04R 25/40* (2013.01); *H04R 25/608* (2013.01); *H04R 25/652* (2013.01); *H04R 25/656* (2013.01); *H04R 25/658* (2013.01); *H04R 2201/10* (2013.01)

(56) References Cited

U.S. PATENT DOCUMENTS 4,381,830 A * 5/1983 Jelonek ..... H04R 25/48 181/129
4,977,976 A * 12/1990 Major ..... H04R 25/48 181/130
5,488,205 A * 1/1996 Major ..... H04R 25/652 181/129
5,975,235 A * 11/1999 Schlaegel ..... H04R 25/48 181/129
6,695,093 B1 * 2/2004 Falco ..... A61F 11/08 181/130
7,027,608 B2 * 4/2006 Fretz ..... H04R 25/65 381/322
7,522,743 B2 * 4/2009 Dobras ..... H04R 1/1058 181/129
8,083,022 B2 * 12/2011 Gommel ..... H04R 25/652 181/135
8,474,571 B1 * 7/2013 Bilan ..... A61B 7/02 181/129
8,488,821 B2 * 7/2013 Kral ..... H04R 25/608 381/312
8,498,436 B2 * 7/2013 Cheng ..... H04R 25/608 381/322
8,718,306 B2 * 5/2014 Gommel ..... H04R 25/60 381/322
9,204,228 B2 * 12/2015 Chan ..... H04R 25/608
9,253,580 B2 * 2/2016 Parsi ..... H04R 25/604
9,392,383 B2 * 7/2016 Nielsen ..... H04R 25/65
2007/0202735 A1 * 8/2007 Hanks ..... H01R 4/5033 439/427
2008/0002848 A1 * 1/2008 Heerlein ..... H04R 25/604 381/328
2009/0080680 A1 * 3/2009 Beyfuss ..... H04R 25/65 381/324
2010/0027825 A1 * 2/2010 Fickweiler ..... H04R 25/60 381/330
2011/0188689 A1 * 8/2011 Beck ..... H04R 1/1066 381/328
2011/0194716 A1 * 8/2011 Gommel ..... H04R 1/1066 381/328
2011/0211716 A1 * 9/2011 Cheng ..... H04R 25/608 381/322

FOREIGN PATENT DOCUMENTS

DE 102010013422 A1 10/2011
DE 102010007610 B4 11/2012
EP 1998593 A1 12/2008
JP H0837697 A 2/1996

* cited by examiner

HEARING AID WITH PLUG CONNECTION FOR EARPIECE

CROSS-REFERENCE TO RELATED APPLICATION

This application is a continuation, under 35 U.S.C. § 120, of copending international application No. PCT/EP2016/053594, filed Feb. 19, 2016, which designated the United States; this application also claims the priority, under 35 U.S.C. § 119, of German patent application No. DE 10 2015 209 741.2, filed May 27, 2015; the prior applications are herewith incorporated by reference in their entirety.

BACKGROUND OF THE INVENTION

Field of the Invention

The invention relates to a hearing aid containing an ear insert having an earpiece and an attachment part which is connected to a receiver. The earpiece and the attachment part each have a plug connector and are connected to each other by the plug connectors. One plug connector is configured as a nozzle which extends in an axial direction along a longitudinal axis and has a thickened portion in the radial direction, and the other plug connector engages behind the thickened portion in order to axially fix the earpiece to the attachment part.

A hearing aid of this kind is described, for example, in German patent DE 10 2010 007 610 B4, corresponding to U.S. Pat. No. 8,718,306. The latter discloses an embodiment in which the receiver has an acoustic nozzle with a thickened portion which is inserted into a socket. The socket is secured on a shield and, with the latter, forms an earpiece. The socket is configured like pincers and engages behind the thickened portion.

A hearing aid is understood in particular as a device for amplifying sound. For this purpose, a hearing aid has a number of microphones, suitable electronics and a receiver, i.e. a loudspeaker. Various hearing aids are differentiated in terms of the positioning of the receiver, on the one hand, and of the remaining electronics in a suitable housing on or in the ear of the user, on the other hand.

In what is called a behind-the-ear (BTE) device, the housing is worn behind the ear. The receiver is either arranged in the housing, with the sound being carried into the auditory canal by a sound tube, or the receiver is configured as an external receiver, attached to the hearing aid via a cable and inserted into the auditory canal. The latter variant is also referred to as a receiver in canal (RIC).

Alternatively, the housing is not worn behind the ear, but instead in the ear. Such a hearing aid is then referred to as an in-the-ear (ITE) device or a completely-in-canal (CIC) device, depending on whether, in addition to the receiver, the housing also sits with its other components partially (ITE) or completely (CIC) in the auditory canal.

The earpiece usually has an outer contour which serves to provide a seal against the auditory canal. Particularly in BTE devices, the earpiece is often configured as a so-called shield, also referred to as a dome. The shield is secured on an attachment part, which in turn is connected to the receiver. In an RIC device, the attachment part is, for example, an attachment nozzle of the receiver. In the case of a receiver worn outside the auditory canal, the attachment part is, for example, a sound tube which is optionally equipped with a suitable connection part for connection to the shield. In principle, any connection solutions suitable for connecting the earpiece to the receiver in an RIC device are also suitable for connecting an earpiece to a sound tube of a BTE device with receiver.

The earpiece is in contact with the auditory canal and is exposed to corresponding forces, especially during insertion into and removal from the auditory canal. There is then the danger of the earpiece coming loose from the attachment part and being left in the auditory canal. Even in the case of an attachment part with a thickened portion, it is not certain, particularly during removal, that a socket engaging behind the thickened portion can be mechanically loaded to a sufficient extent to prevent slipping in the longitudinal direction.

SUMMARY OF THE INVENTION

Against this background, it is an object of the invention to make available a hearing aid in which unwanted detachment of the earpiece is prevented as effectively as possible. This is to be achieved in particular by a plug connection between the earpiece and an attachment part of the hearing aid being as secure as possible and yet straightforward.

The hearing aid is configured in particular as a BTE hearing aid, i.e. as a hearing aid with a housing which is worn behind the ear by the user. To output sound, a BTE hearing aid of this kind has a receiver which is either accommodated in the housing or is worn as an external receiver in the ear. The hearing aid moreover has an ear insert, which has an earpiece, and also an attachment part which is connected to a receiver. The earpiece and the attachment part each have a plug connector and are connected to each other by these two plug connectors. The two plug connectors together form a plug connection between the earpiece and the attachment part.

One of the two plug connectors is configured as a nozzle which extends in an axial direction along a longitudinal axis and has a thickened portion in the radial direction, i.e. perpendicular to the axial direction. This is understood in particular as meaning that the nozzle is widened over a longitudinal portion, i.e. has a greater radial extent than outside of the longitudinal portion. The other plug connector engages behind the thickened portion in order to axially fix the earpiece to the attachment part. By "engages behind" is meant in particular that the other plug connector has a continuation which, considered in the axial direction, is positioned behind the thickened portion and, upon movement in the axial direction, thus abuts against the thickened portion, such that separation of the plug connection is made difficult.

Moreover, the thickened portion has an undercut and forms a retaining surface which runs like a wedge into the thickened portion. In addition to a first undercut, which is formed by the thickened portion overall, a second undercut is accordingly formed in the thickened portion itself. The first undercut is here formed only with respect to the axial direction as it were in the shadow of the thickened portion. However, the second undercut engages in the thickened portion, such that advantageously a protrusion of the thickened portion is formed. The protrusion extends in the axial direction and covers a wedge-shaped or circumferentially funnel-shaped cavity or indent which is arranged between the protrusion and the longitudinal axis. The retaining surface is then a surface of the protrusion and faces generally inward, i.e. is oriented in the direction of the longitudinal axis. The indent is tapered in the axial direction, such that it is approximately wedge-shaped in the cross section parallel to the longitudinal axis. Thus, the retaining surface also extends overall like a wedge, i.e. in particular obliquely with respect to the longitudinal axis. In a variant, the retaining surface is curved but generally runs toward the longitudinal axis.

An advantage of the invention is in particular that a greatly improved protection against pulling out is obtained by the additional undercut into the thickened portion. In the connected state, the other plug connector is guided over the thickened portion of the nozzle but does not simply engage behind the latter; instead it engages like a hook into the rear of the thickened portion, such that securing in the radial direction is also achieved.

At least one of the plug connectors is preferably rotationally symmetrical, preferably both of them. The nozzle is then tubular, with a circumferential thickened portion in the rear face of which, i.e. on a face directed away from the other plug connector, an annular indent and an annular and in particular funnel-shaped retaining surface are formed. Here, "tubular" also includes cross sections that deviate from a round cross section, in particular oval cross sections. The other plug connector is here configured as a socket and in particular has a hollow cylindrical shape. At the end of the other plug connector an opening is then formed, with an opening diameter which is smaller than an internal diameter of the socket, as a result of which the engagement behind the thickened portion is ensured. Inside the socket, an annular elevation is formed around the opening. This elevation has a diameter which preferably corresponds to the opening diameter, such that the elevation directly surrounds the opening. Alternatively, the diameter of the annular elevation is greater than the opening diameter and smaller than the internal diameter of the socket, generally of the other plug connector. Instead of a rotationally symmetrical configuration, the elevation is configured, for example, like a pin or like a tooth and/or the indent is designed as a blind hole, for example.

In principle, the nozzle can be arranged either on the attachment part or on the earpiece, and the other plug connector accordingly on the other part. In the following, however, without restricting the generality, an embodiment is discussed in which the nozzle is arranged on the attachment part and the other plug connector is arranged on the earpiece. The following observations, however, also apply analogously to the alternative embodiment with the nozzle on the earpiece and with the other plug connector on the attachment part.

The attachment part serves for joining the earpiece to the rest of the hearing aid and especially for joining to the receiver. Accordingly, the attachment part has a sound channel through which sound is transported from the receiver to the earpiece. In a hearing aid in which the receiver is worn in the ear, the attachment part is, for example, an attachment nozzle on the receiver. The attachment nozzle is, for example, a structure on the receiver and formed in one piece therewith. In a hearing aid in which the receiver is worn outside the auditory canal, the attachment part is, for example, a sound tube or an end piece which is fitted, in particular secured, on the end of the sound tube. Overall, the attachment part forms one of the plug connectors for joining the earpiece. The attachment part and the earpiece together form the ear insert, which is in particular worn completely in the ear.

In a preferred embodiment, the thickened portion is curved at least in part like a sphere. The connection of the plug connectors is particularly simple with a thickened portion of this kind. The nozzle here is in particular formed proceeding from a ball attachment in which an initially cylindrical main body is additionally surrounded by a spherical shell, such that a thickened portion is obtained having a cross section in the shape of an arc of a circle. An advantage of this embodiment is a hinged connection.

The earpiece is expediently formed in one piece and from an elastic material. The earpiece is thus particularly simple and designed in particular as an inexpensive disposable part. The elastic configuration of the earpiece is particularly useful if the nozzle is arranged on the attachment part, such that the earpiece then has an elastic socket which can be plugged particularly easily onto the nozzle, since the socket can now expand when pushed over the thickened portion and contracts automatically again behind the thickened portion.

The earpiece is configured as a shield. The shield is typically dome-shaped or bell-shaped and is therefore also referred to as a dome. Apart from the opening for fitting it onto the adapter, the shield in a first variant has a closed design. Alternatively, the shield has a number of vents or pressure compensation holes. For example, these are distributed in the circumferential direction about the longitudinal direction. Generally, there are many design options for the shield, depending on which specific function the shield is intended to perform. However, instead of a shield, an ear mold is alternatively also suitable as the earpiece. Such an ear mold is usually prepared on an individual basis and often produced from a non-elastic material. It is then expedient to prepare the attachment part from an elastic material and then also to fit the nozzle on the ear mold, while the other plug connector is formed on the attachment part.

In a suitable embodiment, the other plug connector has a chamber in which the nozzle sits and which completely surrounds the thickened portion. A particularly secure hold is ensured in this way. The chamber is in particular designed complementing the nozzle, such that the latter sits therein with form-fit engagement. To achieve a certain pressure on the nozzle, the chamber is expediently designed to complement the nozzle, without taking the thickened portion into account, such that the thickened portion is braced in the chamber in the connected state. Moreover, measured in the axial direction, the chamber is in particular longer than the thickened portion, such that the latter is fully enclosed.

In an expedient embodiment, a mating surface which bears on the retaining surface is formed in the chamber. This permits simple engagement in the indent of the thickened portion. The mating surface is in particular a surface of an elevation which, starting from the inner wall of the chamber, extends into the latter.

The chamber preferably has a hollow cylindrical taper which surrounds the nozzle and on which the mating surface is formed, in particular in an annular shape. The taper forms an end face of the chamber. The mating surface then protrudes from the end face. For this purpose, the above-described elevation is expediently formed on the end face, e.g. in the manner of a wall or a rib which extends into the interior of the chamber.

The mating surface is preferably designed complementing the retaining surface and covers the latter, in particular completely. In this way, an advantageously particularly large contact surface is obtained in the region of the indent in the thickened portion, hence particularly good protection against pulling out. In the rotationally symmetrical configuration, the surfaces are then correspondingly annular and shaped like a funnel and bear on each other in the connected state of the plug connectors.

The chamber expediently has an opening, in particular formed by the taper, for the insertion of the nozzle into the chamber, wherein the nozzle has a neck portion which is arranged inside the opening and which has a diameter that is at least 10% smaller than the opening. In other words, the external diameter of the neck portion is smaller than the opening diameter of the opening. In particular in combination with a spherically curved thickened portion, a slight tilting of the earpiece relative to the attachment part is then advantageously possible, such that the ear insert can adapt optimally to the usually curved auditory canal. The thickened portion and the chamber advantageously form a hinge, in particular a ball hinge, with a movement clearance defined by the difference between the external diameter of the neck portion and the opening diameter. When the plug connectors are pushed together, the nozzle is introduced through the opening of the taper into the chamber, i.e. into the socket. In the rotationally symmetrical configuration, the taper has a hollow cylindrical shape, the opening is circular and formed centrally in the end face, such that the latter itself is again annular.

The retaining surface generally extends like a wedge, i.e. at an inclination with respect to the longitudinal axis. The retaining surface preferably encloses an angle with the longitudinal axis, which angle is smaller than 90° and greater than 30°. This angle permits a sufficient indent. The angle is particularly preferably between 70 and 45°. Viewed in the cross section parallel to the longitudinal axis, the retaining surface, in a preferred variant, extends in a straight line at the inclination to the longitudinal axis at the corresponding angle. In the rotationally symmetrical configuration, the then annular retaining surface is the lateral surface of a truncated cone, with an opening angle which corresponds to twice the aforementioned angle. The retaining surface is alternatively curved.

To carry sound through the plug connection, a first sound channel portion is expediently formed in the axial direction in the nozzle and leads in the axial direction into a second sound channel portion of the other plug connector. In this way, an overall continuous sound channel is formed which finally leads into a sound outlet opening of the earpiece.

In a suitable development, an ear wax guard is inserted into the sound channel in order to prevent ear wax from getting as far as the receiver. The ear wax guard is advantageously inserted into the sound channel portion of the plug connector of the attachment part, such that it is possible to exchange the earpiece without at the same time having to exchange the ear wax guard. Instead, the latter can then be exchanged separately.

Other features which are considered as characteristic for the invention are set forth in the appended claims.

Although the invention is illustrated and described herein as embodied in a hearing aid with plug connection for earpiece, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
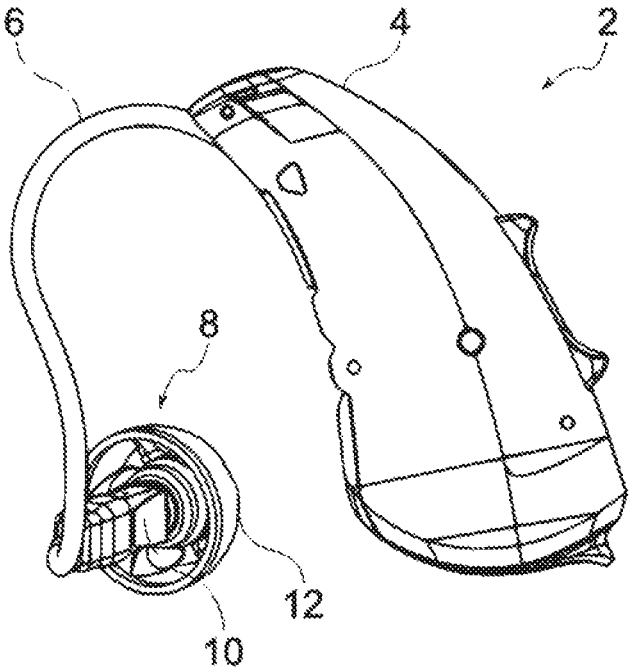
FIG. 1 is a diagrammatic, perspective view of a BTE hearing aid according to the invention.

Referring now to the figures of the drawings in detail and first, particularly to FIG. 1 thereof, there is shown a hearing aid 2, here a BTE hearing aid. The latter has a housing 4, which is worn behind the ear by the user. The housing 4 accommodates, for example, microphones, electronics and a battery (which are not shown). A supply line 6 is mounted on the front of the housing 4 and is guided over the ear and connects the housing 4 to an ear insert 8, which is inserted into the ear. The BTE device shown in FIG. 1 is configured as an RIC device, i.e. the hearing aid 2 has a receiver 10 which is pushed into the ear. In FIG. 1, the receiver 10 is thus a part of the ear insert 8. In an alternative embodiment, the receiver 10 is accommodated in the housing 4, and the supply line 6 is then configured as a sound tube.

It will also be seen from FIG. 1 that the ear insert 8 has an earpiece 12 which is configured here as a shield and which, in the inserted state, bears against the inner wall of the auditory canal and thus seals the auditory canal. For this purpose, the earpiece 12 is produced from an elastic material and is dome-shaped or bell-shaped with a curved outer surface. The ear insert 8 extends along a longitudinal axis L in an axial direction A and, in the illustrative embodiment shown, is also rotationally symmetrical with respect to the longitudinal axis L.

Figure 2:
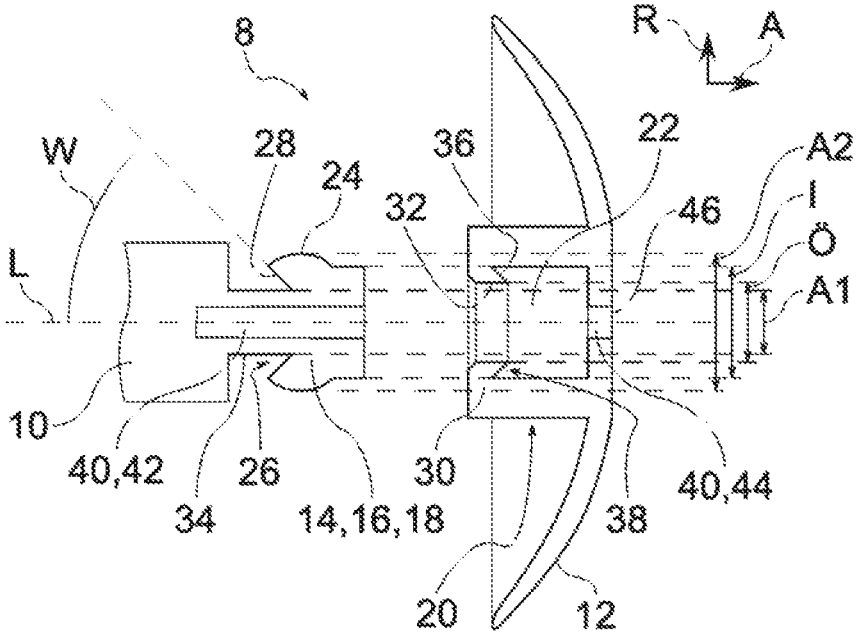
FIG. 2 is a sectional view of an ear insert with attachment part and earpiece.

FIG. 2 shows a variant of the ear insert 8 in a cross-sectional view parallel to the longitudinal axis L. The ear insert 8 is here formed by the receiver 10 and the earpiece 12, which is connected to the receiver 10 via an attachment part 14. In FIG. 2, the earpiece 12 and the attachment part 14 are shown separate from each other. To connect them, these two parts are brought together in the axial direction A and plugged together.

In the illustrative embodiment shown, the attachment part 14 is a part of the receiver 10, namely a front nozzle 16 by which the receiver 10 can be secured on the earpiece 12. The nozzle 16 is at the same time a plug connector 18 of a plug connection with two plug connectors 18, 20. The other plug connector 20 is formed on the earpiece 12, specifically here as a socket, which in turn contains a chamber 22. The nozzle 16 is inserted into this chamber 22 for connection purposes, i.e. for fitting the plug connection together. In an alternative (not shown) with receiver 10 in the housing 4, the attachment part 14 is a separate adapter which is attached to the supply line 6 and then has the nozzle 16 at the end.

To permit axial fixing of the earpiece 12, a thickened portion 24 is formed on the nozzle 16, which thickened portion 24 is in this case spherical in part and curves outward in the radial direction R. At the rear, i.e. in the direction away from the other plug connector 20, i.e. here in the direction toward the receiver 10, an indent 26 is made into the thickened portion 24 and forms a retaining surface 28 which runs like a wedge into the thickened portion 24. On account of the rotationally symmetrical configuration shown here, the retaining surface 28 is funnel-shaped here and formed as the lateral face of a truncated cone. The retaining surface 28 itself extends in a straight line and obliquely with respect to the longitudinal axis L, such that the retaining surface 28, in the cross section shown, encloses an angle W with the longitudinal axis L. This angle W is smaller than 90°, such that the retaining surface does not extend exactly perpendicular to the longitudinal axis L and form a regular undercut. Instead, the retaining surface 28 extends at an inclination to the longitudinal axis L, such that the indent 26 is designed as an annular cavity between the retaining surface 28 and the longitudinal axis L. In FIG. 2, the angle W is approximately 45°. In principle, however, a curved profile is also conceivable. Generally, an additional undercut in the radial direction R is formed by the retaining surface 28.

The other plug connector 20 is configured complementing the nozzle 16. On the rear face of the plug connector 20, a hollow cylindrical taper 30 is formed which at the same time closes off the chamber 22 to the rear. The taper 30 moreover forms an opening 32 of the chamber 22. The nozzle 16 can be inserted into the chamber 22 through this opening 32. During insertion, the taper 30 is initially widened by the nozzle 16, pushed over the thickened portion 24 and, finally, draws together again behind the latter. In the connected state, the taper 30 is then positioned behind the thickened portion 24 and extends round a neck portion 34 which adjoins the rear of the thickened portion 24 and which forms a part of the nozzle 16.

A mating surface 36 is moreover formed on the taper 30, which mating surface 36 faces into the chamber 22 and is configured as the surface of an elevation 38. The elevation 38 is ring-shaped here and surrounds the opening 32. The mating surface 36 is configured complementing the retaining surface 28, such that these two surfaces bear on each other in the connected state and the elevation 38 engages in the indent 26. In this way, the earpiece 12 is secured particularly effectively against being accidentally pulled off. Nonetheless, in the illustrative embodiment shown, a certain movement clearance is provided by the fact that the earpiece 12 is tiltable relative to the attachment part 14. This is achieved by the fact that the opening 32 has an opening diameter Ö which is slightly greater than an external diameter A1 of the neck portion 34, namely by at least 10% or so. In combination with the spherical thickened portion 24, a hinge is then formed which permits tilting of the earpiece 12.

The nozzle 16 as a whole has an external diameter A2, which is a maximum external diameter and is defined by the thickened portion 24. The chamber 22 is then in particular designed in such a way that it has an internal diameter I which is smaller than the external diameter A2 of the nozzle 16, such that the latter is braced in the chamber 22. Nevertheless, tilting is still possible, in particular since the earpiece 12 is preferably produced from an elastic material.

To transmit sound from the receiver 10, a sound channel 40 is formed along the longitudinal axis L all the way through the ear insert 8. For this purpose, each of the two plug connectors 18, 20 has a sound channel portion 42, 44, namely a first sound channel portion 42 and a second sound channel portion 44, which together form the sound channel 40. The latter finally ends in a sound outlet opening 46 of the earpiece 12.

The following is a summary list of reference numerals and the corresponding structure used in the above description of the invention:

2 hearing aid
4 housing
6 supply line
8 ear insert
10 receiver
12 earpiece
14 attachment part
16 nozzle
18,20 plug connector
22 chamber
24 thickened portion
26 indent
28 retaining surface
30 taper
32 opening
34 neck portion
36 mating surface
38 elevation
40 sound channel
42 first sound channel portion
44 second sound channel portion
46 sound outlet opening
A axial direction
A1 external diameter (of the neck portion)
A2 external diameter (of the nozzle)
I internal diameter (of the chamber)
L longitudinal direction
R radial direction
W angle
Ö opening diameter

The invention claimed is:

1. A hearing aid, comprising:

a receiver; and an ear insert having an earpiece and an attachment part connected to said receiver, said earpiece and said attachment part each having a plug connector and are connected to each other by means of said plug connectors, wherein a first said plug connector is configured as a nozzle extending in an axial direction along a longitudinal axis and having a neck portion and a thickened portion adjoining said neck portion in the axial direction and extending in a radial direction, and a second said plug connector engaging behind said thickened portion for axially fixing said earpiece to said attachment part, said thickened portion, viewed in the axial direction, having an undercut formed therein and forming a retaining surface running like a wedge into said thickened portion, said retaining surface extending obliquely with respect to the longitudinal axis.

2. The hearing aid according to claim 1, wherein said thickened portion is curved at least in part like a sphere.

3. The hearing aid according to claim 1, wherein said earpiece is formed in one piece and from an elastic material.

4. The hearing aid according to claim 1, wherein said second plug connector has a chamber and in said chamber said nozzle sits and said chamber completely surrounds said thickened portion.

5. The hearing aid according to claim 4, wherein said chamber has a mating surface which bears on said retaining surface.

6. The hearing aid according to claim 5, wherein said chamber has a hollow cylindrical taper which surrounds said nozzle and on which said mating surface is formed.

7. The hearing aid according to claim 5, wherein said mating surface is configured complementing said retaining surface and covers said retaining surface.

8. The hearing aid according to claim 4, wherein:

said chamber has an opening formed therein for an insertion of said nozzle into said chamber; and said neck portion of said nozzle is disposed inside said opening and has a diameter that is at least 10% smaller than said opening.

9. The hearing aid according to claim 1, wherein said retaining surface encloses an angle with the longitudinal axis, said angle being smaller than 90° and greater than 30°.

10. The hearing aid according to claim 1, wherein said nozzle has a first sound channel portion formed in the axial direction and leads in the axial direction into a second sound channel portion of said second plug connector.

11. The hearing aid according to claim 1, wherein:

said thickened portion is curved at least in part like a sphere;

said second plug connector is a hollow cylindrical socket with a chamber;

said nozzle sits in said chamber; and said chamber completely surrounds said thickened portion.

12. The hearing aid according to claim 11, wherein:

said chamber has a mating surface bearing on said retaining surface;

said chamber has a hollow cylindrical taper surrounding said nozzle and on which said mating surface is formed;

said mating surface is configured complementing said retaining surface and covers said retaining surface;

said retaining surface encloses an angle with the longitudinal axis, said angle is smaller than 90° and greater than 30°; and said nozzle has a first sound channel portion formed in the axial direction and leads in the axial direction into a second sound channel portion of said second plug connector.

13. The hearing aid according to claim 12, wherein said earpiece is formed in one piece and from an elastic material.

14. The hearing aid according to claim 1, wherein the hearing aid is a behind-the-ear hearing aid.

* * * * *